US007992508B1

(12) United States Patent
Norton

(10) Patent No.: US 7,992,508 B1
(45) Date of Patent: Aug. 9, 2011

(54) REMOTELY OPERATED WATERCRAFT DOCKING MECHANISM HAVING FUEL SAVING AND THEFT THWARTING ATTRIBUTES

(76) Inventor: Daniel A. Norton, Cary, NC (US)

( * ) Notice: Subject to any disclaimer, the term of this patent is extended or adjusted under 35 U.S.C. 154(b) by 315 days.

(21) Appl. No.: 12/386,451

(22) Filed: Apr. 17, 2009

Related U.S. Application Data

(60) Provisional application No. 61/124,773, filed on Apr. 21, 2008.

(51) Int. Cl.
*B63B 21/00* (2006.01)

(52) U.S. Cl. ..... 114/231; 114/230.16; 114/230.18

(58) Field of Classification Search ..... 114/230.1, 114/230.16, 230.2, 230.26, 231, 248, 249, 114/230.18
See application file for complete search history.

(56) References Cited

U.S. PATENT DOCUMENTS 1,154,133 A * 9/1915 Seltzer ..... 114/231
3,177,839 A * 4/1965 Nolf ..... 114/230.18
3,442,241 A * 5/1969 Daunis ..... 114/230.1
4,641,598 A 2/1987 Hodges
5,542,783 A 8/1996 Pollack
5,715,770 A * 2/1998 Heyworth ..... 114/249
6,508,190 B1 1/2003 Norton
6,851,380 B1 2/2005 Khoury et al.

* cited by examiner

*Primary Examiner* — Lars A Olson
(74) *Attorney, Agent, or Firm* — Robert Nathans

(57) ABSTRACT

A docking mechanism comprises first and second units, operative to firmly attach and release a watercraft such as a ferry boat to a dock. This action can be produced by actuators that may be hydraulic or pneumatic actuators, or by other means such as manually actuated levers, electric motors or solenoids. A moveable locking piston acts to push locking cylinders or other locking members such as movable links against watercraft lock channels mounted upon the watercrafts. The apparatus results in very firm coupling of a watercraft to the dock, beneficially permitting ferry boats to load and unload cargo without keeping their engines running which wastes fuel and pollutes the environment. The lock channels on the watercraft are however configured to permit relative vertical motion between the watercraft and the latching assembly to account for water level changes and yet maintain very firm coupling of the watercraft to the dock.

22 Claims, 9 Drawing Sheets

REMOTELY OPERATED WATERCRAFT DOCKING MECHANISM HAVING FUEL SAVING AND THEFT THWARTING ATTRIBUTES

This application claims the benefit of U.S. provisional application 61/124,773, filed Apr. 21, 2008.

BACKGROUND OF THE INVENTION

The present invention relates generally to the field of commercial and recreational watercraft docking and in particular to a remotely operable docking mechanism that allows small and large watercrafts such as ferry boats in particular, to safely couple to a dock.

Applicant believes that passenger and cargo ferries in major city ports around the globe spend as much as 50% of their fuel costs throttling their engines at close to full power just to hold the vessel against the dock when loading and unloading. Not only is this expensive but it wastes valuable diesel fuel, and is one of the major causes of pollution in today's transportation market.

BRIEF SUMMARY OF A PREFERRED EMBODIMENT OF THE INVENTION

Accordingly, the present invention provides a docking mechanism for quickly and easily securely holding a watercraft such as a ferry, directly against a stationary dock to allow the ship to quickly throttle down. No ropes are needed, as they are in traditional docking procedures. The captain simply steers the ship toward the target markings on the dock and the docking mechanism does the rest. The result is major savings in fuel cost, as well as providing a more environmentally friendly solution for major ports across the globe. It can also be employed to deter watercraft theft.

The remotely operated docking mechanism provides a quick-acting positive restraint for commercial vessels such as ferries and cargo ships, and the device can be used for personal watercraft such as motorboats and sailboats. The device is also particularly useful for remotely and automatically docking Unmanned Underwater Vehicles (UUVs), Remotely Operated Vehicles (ROVs) and other otherwise robotic watercraft such as Unmanned Surface Vessels (USVs). The system of the invention uses the forward momentum force of the vessel to automatically engage a vertically oriented target lock channel mounted on the hull of the ship. As the ship approaches the dock, the V-shaped structure affixed to the dock acts to guide the vessel toward the center of the latching assembly. Then a drive piston, driven by a piston actuator, acts to push a set of locking members that can be link mounted locking cylinders against particular inner angular surface portions of the target channel, creating a failsafe lock. The particular angles of the lock channel and drive piston surfaces are configured to maximize mechanical advantage and maintain a high locking force to ensure a positive locking connection of the watercraft to and firmly against the dock. Furthermore, there is a failsafe engagement surface on the piston that acts to trap the cylinders in the locked position, so even in the event of a loss of power applied to the drive piston actuator, this failsafe feature will keep the vessel securely latched to the dock.

The drive piston, and the link mounted locking cylinders lock anywhere along the length of the vertical lock channel mounted upon the watercraft, which is configured to allow vertical play to account for the ship's motion in the water relative to the stationary dock, or to account for tidal changes.

The locking mechanism has converging surfaces forming a portion of a "V" shape which acts as a guide along which the Lock Channel slides. At the center of the "V" is the pneumatic, electric, hydraulic, or manually actuated moveable locking piston. A conventional control interface from the cockpit is used to release the Latch, and the lock channel is allowed to slide out, releasing the vessel from the dock.

The same mechanisms can also be used for the pleasure, commercial or military vessel industry, where it can provide a quick and easy method to securely attach ship to ship without the need for ropes or extra deckhands. Such applications are used for rescue situations, towing or pushing vessels (tugboat applications). The failsafe mechanism increases safety and can even prevent theft.

The present invention can also be used for the pleasure boat industry, where it can provide a quick and easy method to securely attach a boat to a boat trailer without the need for ropes or extra deckhands. A manual or spring actuated locking piston can allow the operator to save time when loading a boat onto its trailer for transport. The failsafe mechanism increases safety and can even prevent theft.

DESCRIPTION OF THE DRAWINGS

Other features of the invention will become apparent upon reading of the detailed description, taken in conjunction with the drawings in which.

DETAILED DESCRIPTION OF PREFERRED EMBODIMENTS OF THE INVENTION

Figure 1:
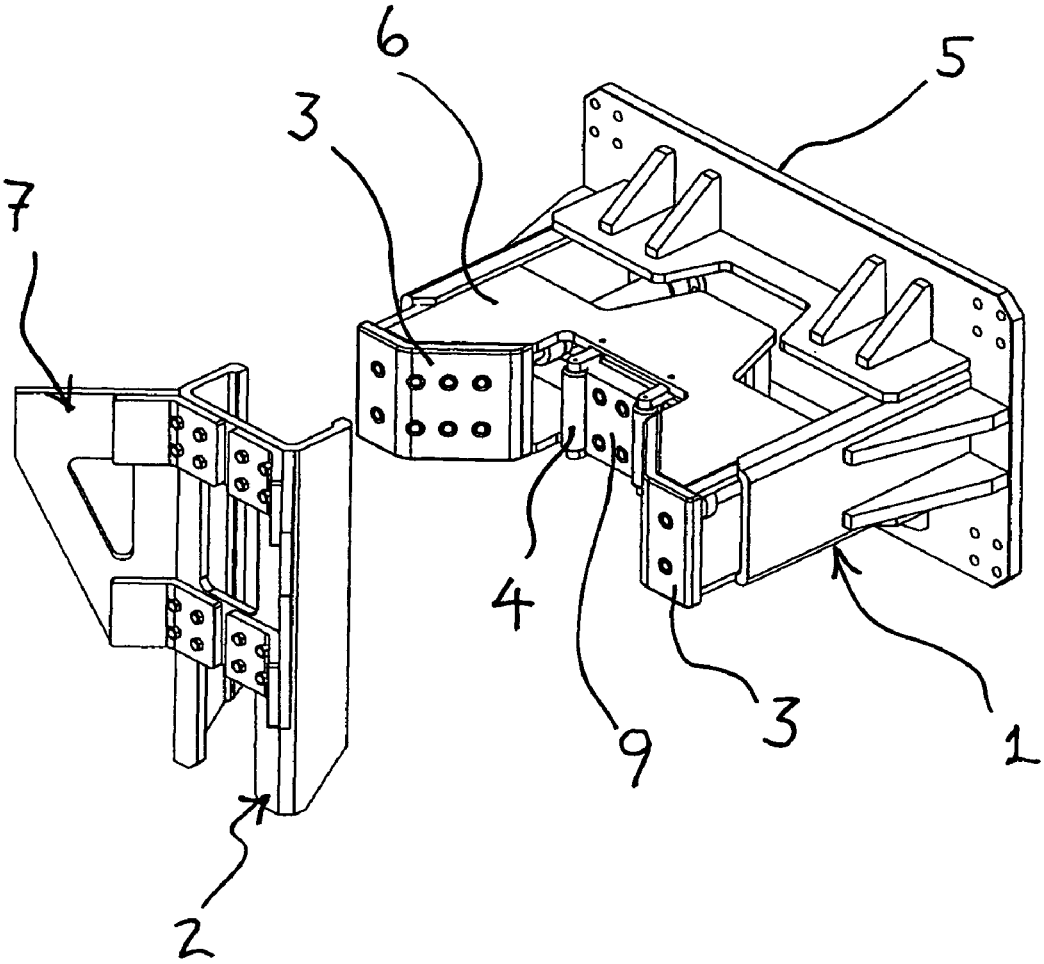
FIG. 1 is an isometric view of the lock channel on approach to the latching assembly.
Figure 2:
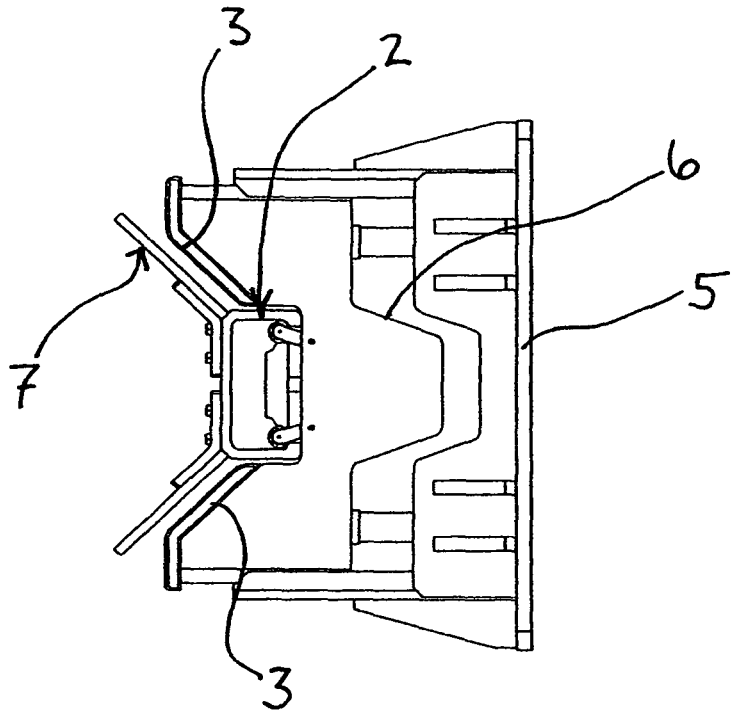
FIG. 2 is a top view of the latching assembly fully coupled to the lock channel.
Figure 3:
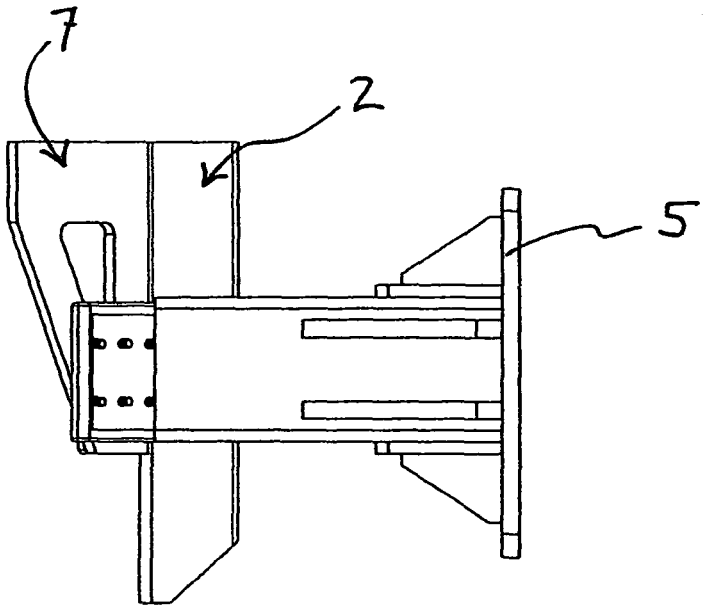
FIG. 3 is a side view of the latching assembly fully coupled to the lock channel.
Figure 7A:
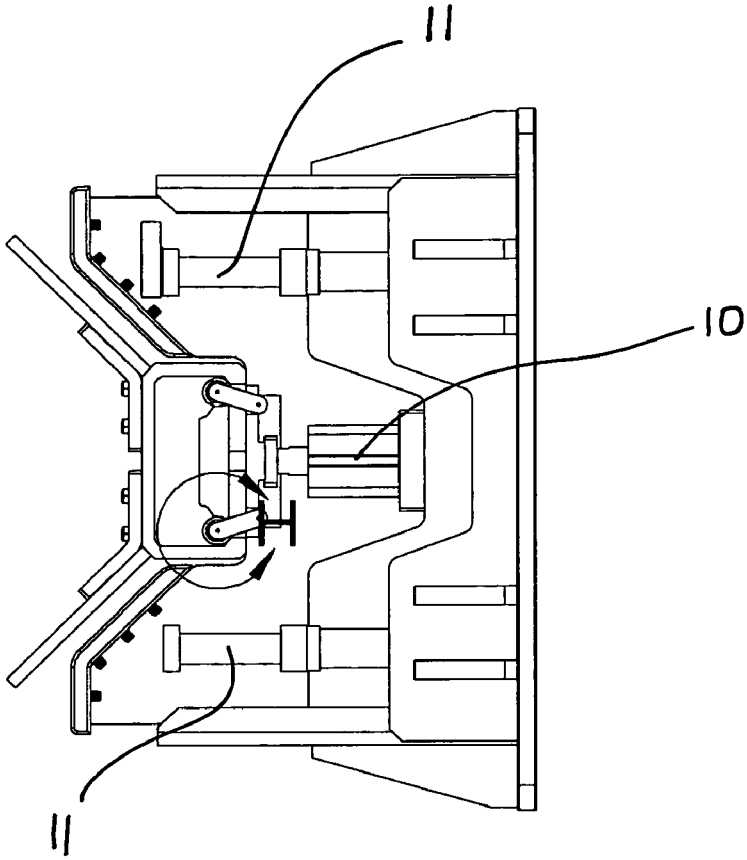
FIG. 7*a* is a wire frame top view of the latching assembly fully coupled to the lock channel, where the view illustrates a compliance mechanism, piston actuator, pivotable cylinders.
Figure 7B:
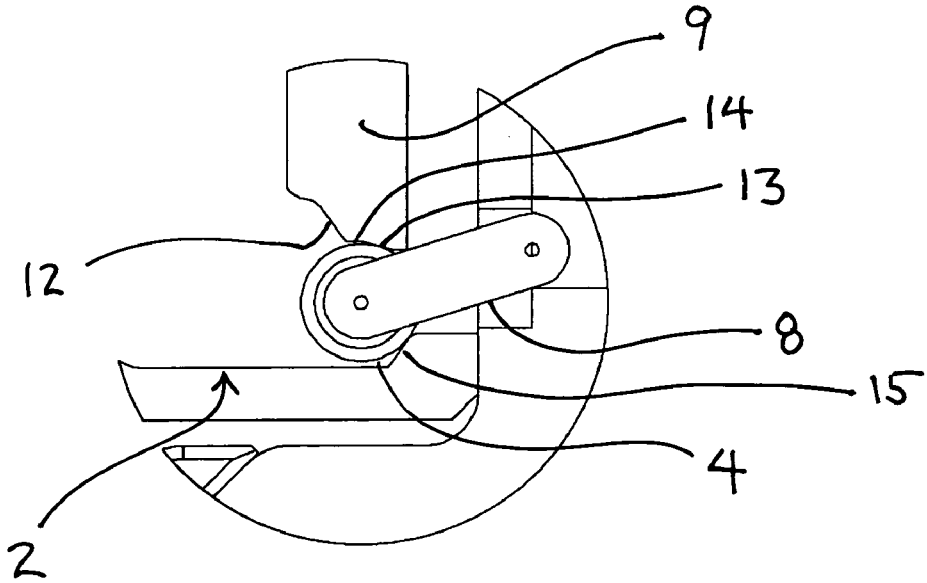
FIG. 7*b* is a detailed top view of a pivotable cylinder, optional pivotable cylinder arm, lock channel, and details the angled surfaces on the lock channel and the moveable locking piston angled surfaces.

As shown in FIG. 1, the docking mechanism has a latching assembly 1 mounted to a dock which includes a mounting plate 5, a set of "V" shaped guide surfaces 3, a main housing 6, and a moveable locking piston 9. As shown in FIGS. 7*a* and 7*b* taken together, a set of locking members that are movable cylinders 4 are attached to the main housing 6 via optional cylinder arms 8, and a drive piston actuator 10, and an omni-directional compliance mechanism 11 is also provided. The omni-directional compliance mechanism dampens the shock load of the vessel as it docks, as well as allowing limited movement of the vessel relative to the dock to accommodate various water conditions. The first unit can be called the latching assembly 1, and can also be equipped with a variety of sensors to detect lock and unlock status of the mechanism as well as detection of target presence in the mechanism. The latching assembly 1 can also be equipped with a variety of actuator control electronics, infrared receivers, hydraulic or pneumatic actuator hoses coupled to the piston actuator 10 (FIG. 7*a*) to drive the piston back and forth, and lock status indicator lights. These can also be remotely mounted separate from the latching assembly 1 depending on the requirements of the particular application. A handle or lever (not shown) can be mounted near the latching assembly 1 which can manually control the locking action of the assembly, or the locking action can be controlled remotely from the ship being docked, or from any other location by hydraulically or pneumatically driving the piston actuator 10 back and forth between the locking and unlocking positions via a wireless signal.

The docking mechanism has a second unit mounted to the ship's hull which includes a special vertically oriented "C" lock channel 2, and a supporting structure 7 shown in FIGS. 1-4, which is sized and shaped appropriately to help distribute the loads created from the forward momentum of the ship being docked, as it comes into contact with the latching assembly. Lock channel 2 features a special angled engagement surface 15 on inside portions shown in FIG. 7*b*. These angled surfaces are the engagement surfaces of latching assembly 1.

Figure 11A:
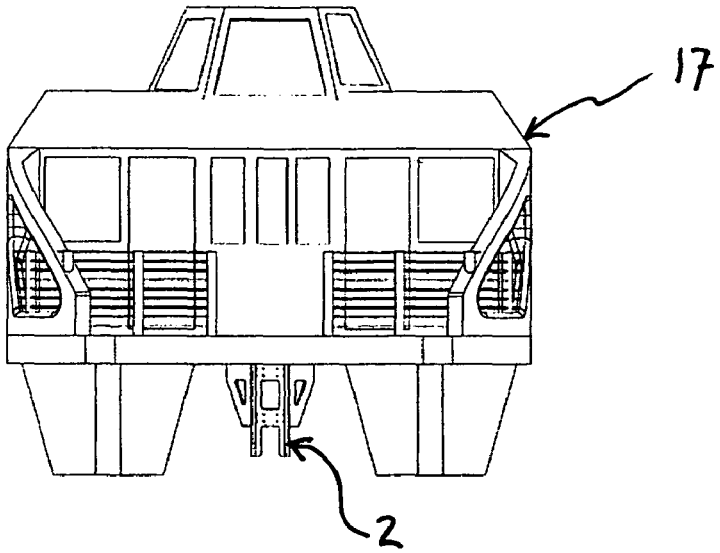
FIG. 11*a* is a front view of a representative ferry boat with the lock channel mounted to its hull.
Figure 11B:
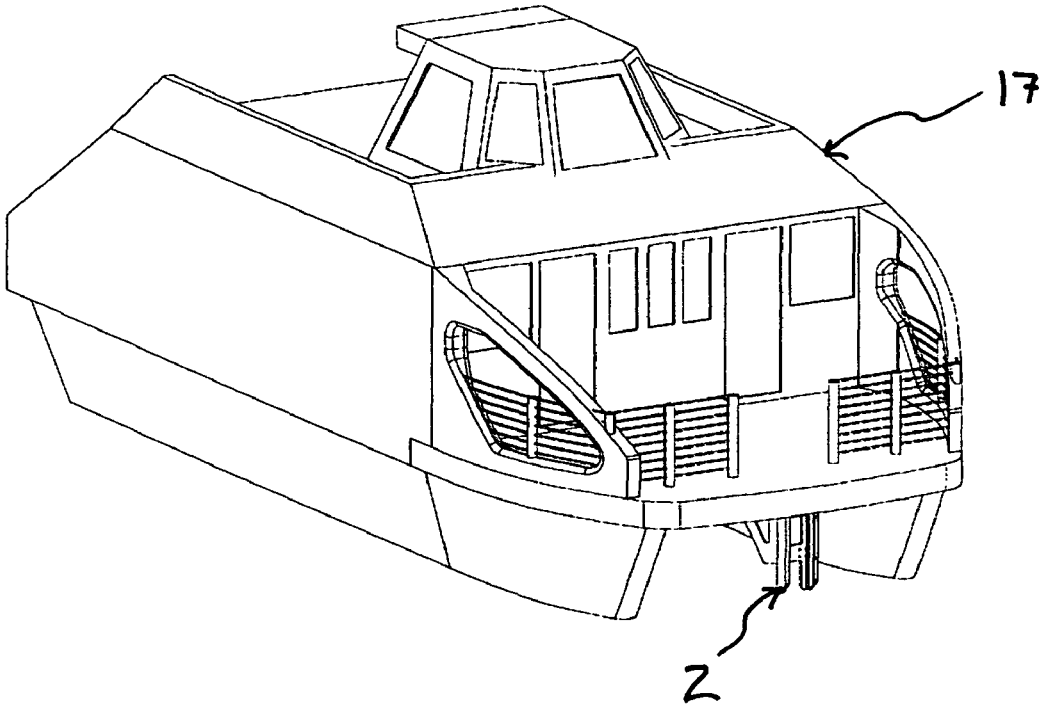
FIG. 11*b* is an isometric view of a representative ferry boat with the lock channel mounted to its hull.

FIGS. 11*a* and 11*b* show a representative ferry boat 17 with the lock channel 2 mounted to its hull.

FIG. 11*b* is an isometric view of a representative ferry boat with the lock channel mounted to its hull.

Figure 8:
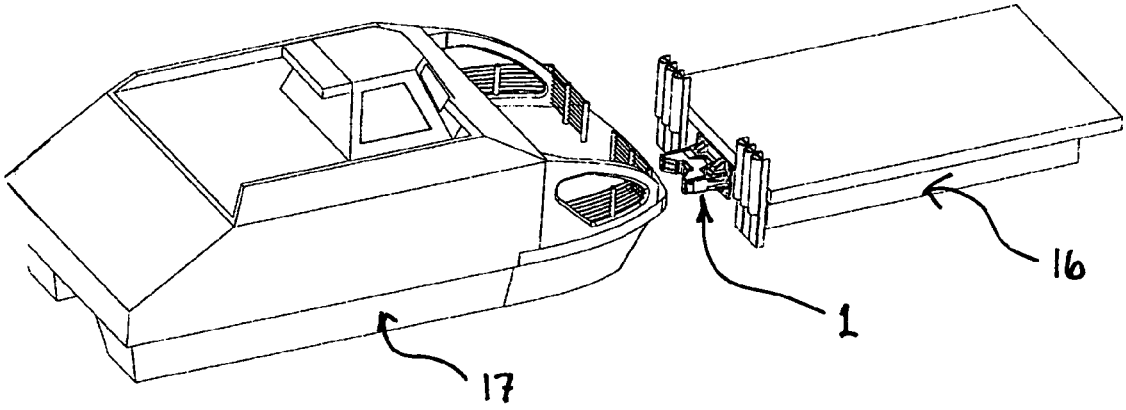
FIG. 8 is an isometric view of the locking assembly mounted to a dock, and a representative ferry boat on approach to the dock.
Figure 9:
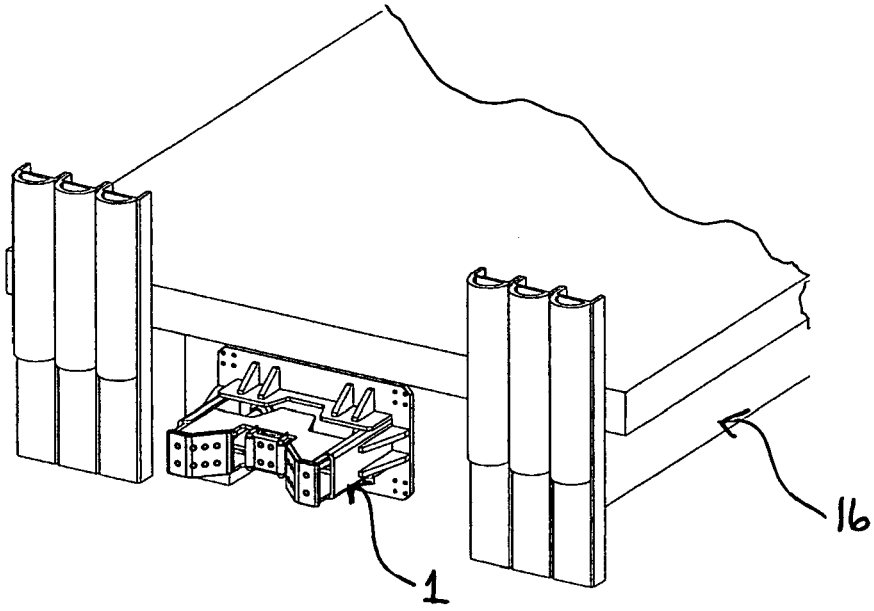
FIG. 9 is an isometric view of the latching assembly mounted to a dock.

The function of the presently preferred embodiment of the invention may be explained means of a step by step process as a watercraft 17 of FIG. 8 approaches the latching assembly 1 and is to be docked.

Figure 4:
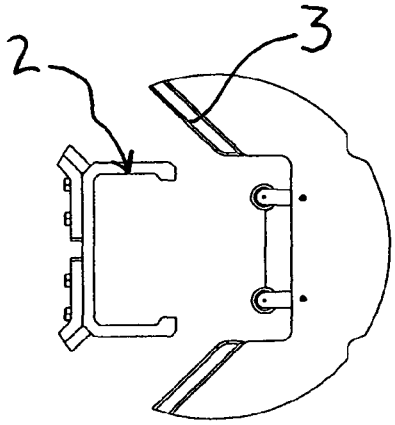
FIG. 4 is a detail top view of the lock channel on approach to the latching assembly, whereas the latching assembly is in unlock position, ready to engage.

As a watercraft, such as a motorboat, sailboat, ferry 17 or cargo ship, or robotic watercraft approaches the dock 16, the lock channel 2 is mounted upon its hull in a location towards the front of the ship, or towards the side, wherever it is intended to best engage with the latching assembly 1 (FIG. 4).

Figure 5:
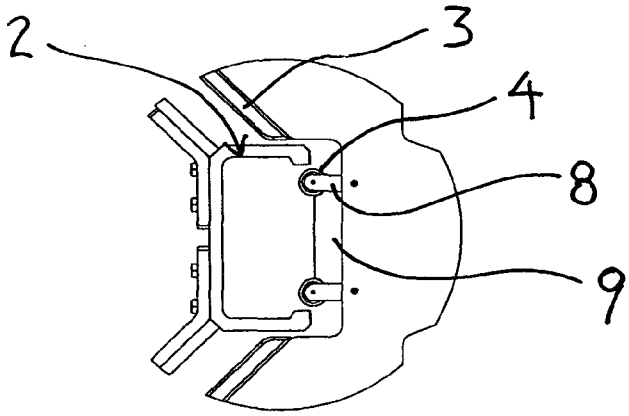
FIG. 5 is a detail top view of the lock channel just before engaging with the latching assembly.

The latching assembly 1 is mounted to the dock 16 (FIG. 8), and is in an unlocked state (FIG. 8) so as to allow the lock channel 2 to slide forward. The moveable locking piston 9 (FIG. 5) is retracted, and the latching assembly 1 is ready to engage.

Figure 6:
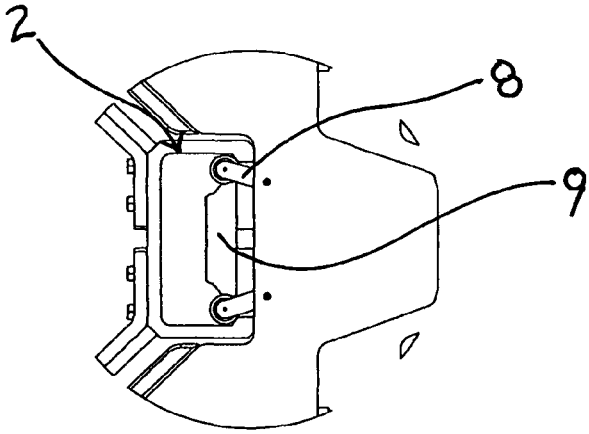
FIG. 6 is a detail top view of the lock channel fully engaged and coupled with the latching assembly, whereas the latching assembly is in the lock position.

As the watercraft approaches closer, the lock channel 2 contacts the "V" shaped guide surfaces 3 on the latching assembly 1 (FIG. 6) and the "V" shaped guide surfaces 3 direct the lock channel 2 into the center of the latching assembly 1.

At this time there may be a significant forward force caused by the watercraft's forward momentum. This momentum causes a conventional omni-directional compliance mechanism 11 (FIG. 7*a*) to comply and act to dampen the force. The compliance mechanism 11 is mounted upon the main housing 6, in turn coupled to mounting plate 5 (FIG. 1). When the compliance mechanism 11 is contacted, it complies and acts to dampen the forward momentum force to allow the main housing 6 to move toward the mounting plate section 5. Once the forward momentum force is dampened, the compliance mechanism 11 extends back to allow the latching assembly 1 to return to its original uncompressed state, even with the ship fully engaged. Furthermore, the compliance mechanism 11 functions to dampen the forces caused by rough waters and other inadvertent motion of the ship while it is engaged.

Once the lock channel 2 is in the center of the latching assembly 1, the moveable locking piston 9 is extended via the piston actuator 10 (FIG. 7*a*). As the piston 9 extends, it pushes the pivotable cylinders 4 in an outward direction from center so that they engage the inner angled surfaces 15 of the lock channel 2 (FIGS. 7*a*, 7*b*). The moveable locking piston 9 features a plurality of contact surfaces at specific angles each serving a different purpose. As the moveable locking piston 9 moves toward the latched state, the movable cylinders 4 roll against the first angled piston surface 12 that acts to move the pivotable cylinders 4 away from each other and toward the locked position; note optional rotatable links 8 (FIG. 7*b*). The pivotable cylinders 4 can be attached to optional rotatable links 8, or can be otherwise housed in a cage-like housing and allowed to roll freely against the corresponding angled surfaces, much like a roller bearing assembly. Then as the piston 9 continues to move toward the latched or locked state, pivotable cylinders 4 roll against the second angled surface of the piston 13, which is where the pivotable cylinders 4 are wedged against the inner angled surfaces 15 on the lock channel 2, thus providing a locked state as shown in FIG. 7*b*. The wedging effect of the piston lock angle 13 against the pivotable cylinders 4 and the inner angled surfaces 15 on the lock channel 2 act to provide maximum mechanical advantage and an optimized latching force. The moveable piston features a final failsafe angled surface 14 where, in the event of a loss of a pushing holding force on the piston 9, due to actuator power loss e.g. a hydraulic or pneumatic pressure drop, the failsafe angled surface 14, co-acting with surface portion 15, acts to trap the pivotable cylinders 4 in a latched position, which provides a redundant safety feature and ensures the ship will not uncouple from the dock.

Figure 13:
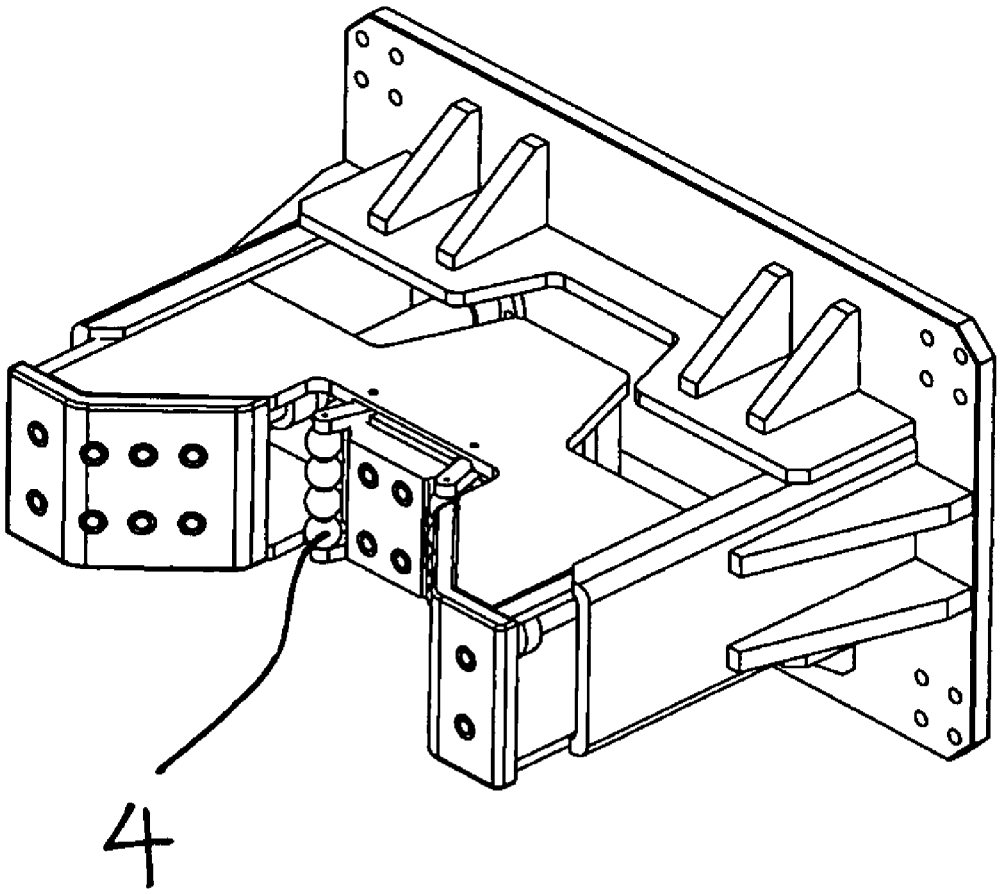
FIG. 13 shows locking cylinders having a variety of surface grooves, pits, cavities or detents that facilitate cylinder cleaning.

As shown in FIG. 13, the pivotable cylinders 4 can be configured having a variety of surface grooves, pits, cavities or detents that act to alleviate debris buildup and allow for easier washout and increased durability.

The pivotable cylinders 4 can be any length as is deemed appropriate for the particular application. The pivotable cylinders can even be so short as to take the shape of spherical balls as is appropriate for the application.

The first and second units can be made from marine grade steels, stainless steel locking components, or similar such materials that would facilitate a durable and long lasting construction that withstands the corrosion effects of a salt water or freshwater environment.

It is important to note that the latching assembly 1 is not limited to being mounted upon a dock 16, and the lock channel 2 is not limited being mounted upon a ship's hull. For example, an alternate acceptable equivalent application may allow the latching assembly 1 to be integrated into the structure of the ship's hull, and the lock channel 2 would be mounted to the dock 16.

Another alternate acceptable application of the invention would allow the latching assembly 1 to be integrated into the structure of a vehicle trailer, and the lock channel 2 would be mounted to the Ship's hull, thus providing a secure docking method for a boat to its trailer.

Furthermore, the worker in the art would understand that an acceptable equivalent alternative is to have the lock channel 2 be oriented in a horizontal fashion, in contrast with FIG. 1, which would allow variance in horizontal positioning of the ship prior to docking.

Furthermore, an acceptable equivalent alternative is to have the latching assembly be moveable relative to the lock channel 2 even when fully locked, which would allow the ship to slide along the length of the lock channel 2 to account for tidal changes and for the horizontal rail, allow the vessel to be moved along the rail to another location.

Figure 10:
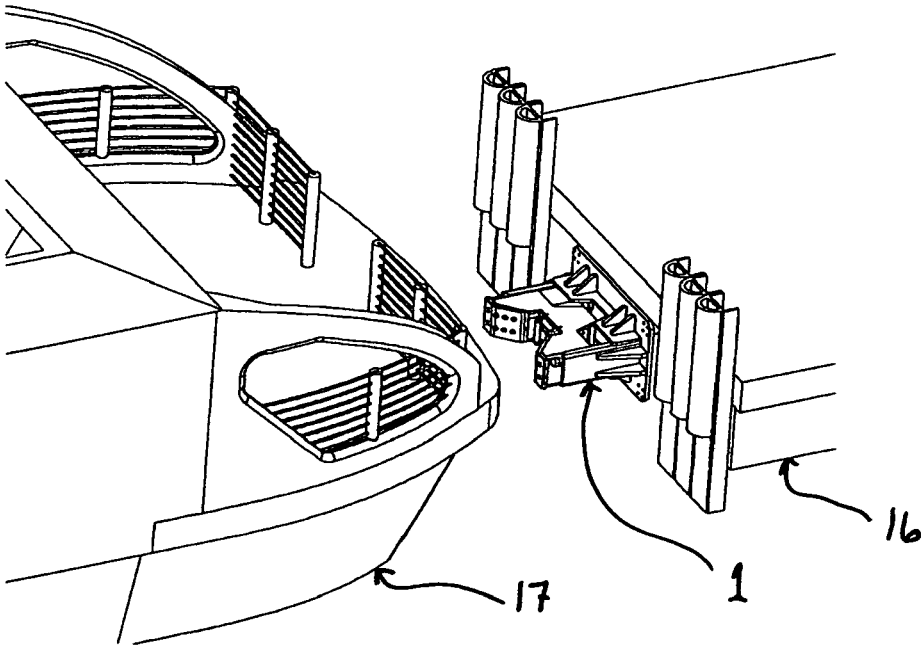
FIG. 10 is an isometric close up view of the latching assembly mounted to a dock, and a representative ferry boat on approach to the dock.
Figure 12A:
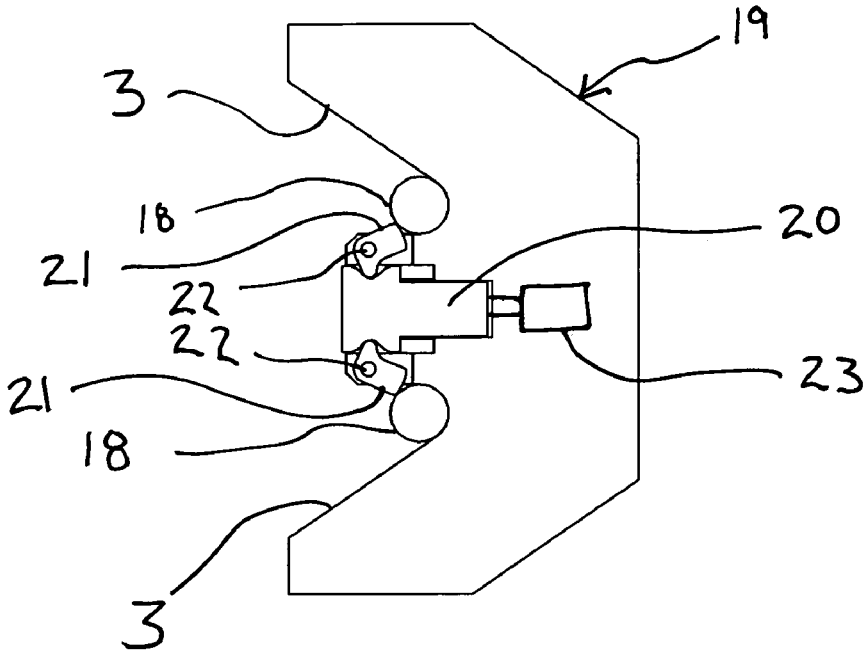
FIG. 12*a* is a top view of the alternate embodiment of the invention, showing the alternate latching assembly fully coupled to the lock target.
Figure 12B:
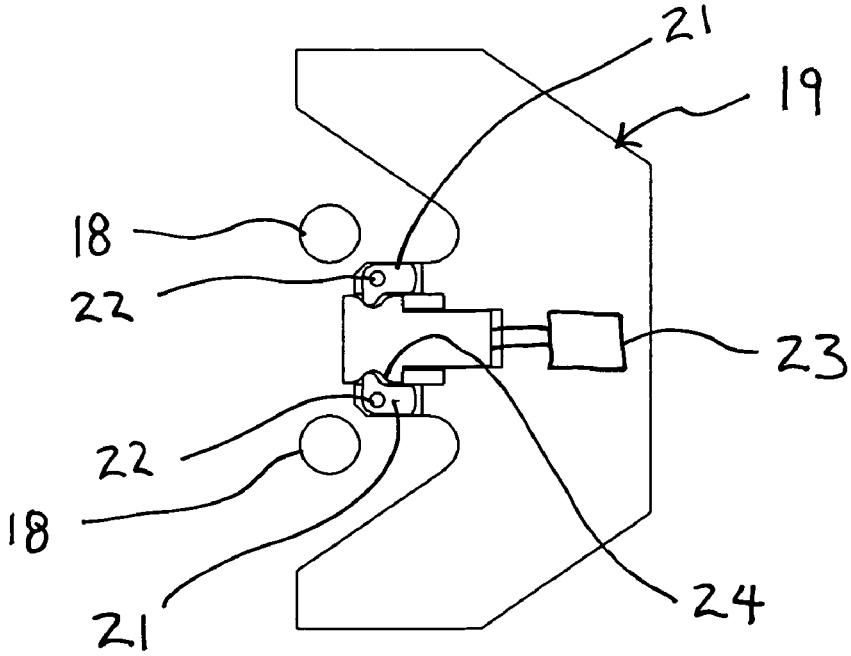
FIG. 12*b* is a top view of the alternate embodiment of the invention, showing the alternate latching assembly uncoupled from the lock target, allowing the lock target to be released.

An alternate embodiment of the described invention is shown in FIGS. 12*a* and 12*b*. The docking mechanism includes a latching assembly 19 mounted to a dock 16 (FIG. 10) via a mounting plate, a set of "V" shaped guide surfaces 3, a main housing, a moveable locking piston 20, a set of pivotable linkages 21, constituting locking members, attached to the main housing via hinge points 22, a piston actuator 23, and an omni-directional compliance mechanism (not shown) which functions as described above. As in the first embodiment, the latching assembly 19 can also be equipped with a variety of sensors to detect lock and unlock status of the mechanism as well as detection of target presence in the mechanism. As in the first embodiment, the latching assembly 19 can also be equipped with a variety of actuator control electronics, infrared receivers, hydraulic or pneumatic actuator hoses, and lock status indicator lights. These can also be remotely mounted separate from the latching assembly 19 depending on the requirements of the particular application. A handle or lever can be mounted near the latching assembly 19 which acts to control the locking action of the unit, or the unit can be controlled remotely from the ship being docked, or from any other location.

The docking mechanism has a locking channel or latching target 18 mounted to the ship's hull which includes a special vertically oriented pair of rods 18 and a supporting structure which is sized and shaped appropriately to help distribute the loads created from the forward momentum of the ship being docked, as it comes into contact with the Latching Assembly 19.

The function of this embodiment may be explained by a step by step process as a watercraft approaches the latching assembly and is to be docked. As a watercraft, such as a motorboat, sailboat, ferry 17 or cargo ship, approaches the dock 16, the latching target 18 is mounted to its hull in a location towards the front of the ship, or towards the side, wherever it is intended to best engage with the latching assembly 19.

The latching assembly 19 is mounted to the dock 16, and is in an unlocked state as shown in FIG. 12*b*, so as to allow the latching target 18 to slide forward. The moveable locking piston 20 is extended which allows the linkages 21 to remain retracted and ready to engage the latching target 18.

As the watercraft approaches closer, the latching target 18 contacts the "V" shaped guide surfaces 3 on the latching assembly 19. The "V" shaped guide surfaces 3 direct the latching target 18 into the center of the latching assembly 19.

At this time there may be a significant forward force caused by the watercraft's forward momentum. As described above, this momentum causes the compliance mechanism to comply and act to dampen the force. The compliance mechanism 11 is mounted to the main housing and to the mounting plate section. When the compliance mechanism is activated, it allows the main housing to move relative to the mounting plate section. Once the force is dampened, the compliance mechanism extends back to allow the Latching Assembly 19 to return to its original uncompressed state, even with the ship fully engaged. Furthermore, the compliance mechanism 11 functions to dampen the forces caused by rough waters and other inadvertent motion of the ship while it is engaged.

Once the latching target 18 is in the center of the latching assembly 19, the moveable locking piston 20 is retracted via the piston actuator 23 to lock latching target 18 to latching assembly 19 as shown in FIG. 12*a*. The piston features one or more grooves 24. As the piston 20 retracts, it forces the pivotable linkages 21 to rotate about their hinge points 22 so that they engage the rods of the latching target 18 in a locking position to firmly lock the watercraft to the dock (FIG. 12*a*).

The docking mechanism of the invention the "Smartlander"™ Nautical Landing System, should be useful for any size vessel, leisure, commercial or military including:

Passenger Commuter Ferries
Cargo Ferries (Car Carriers/Roll-On, Roll-Off Ferries)
Freighters
Oil Platforms
Naval Mooring Applications
Submarine Applications
Latch Integrated into new Hull Designs
Superyachts
JetSkis
Boat Dinghies and other small personal watercraft
Underwater robotic unmanned vehicles The docking mechanism of the invention can also be adapted to allow for a boat vehicle trailer application where the mechanism facilitates the quick and secure coupling of a boat to its vehicle trailer.

While the invention has been described in connection with preferred embodiments, the description is not intended to limit the scope of the invention to the particular forms set forth, but on the contrary, it is intended to cover such alternatives, modifications, and equivalents as may be included within the spirit and scope of the invention as indicated by the language of the appended claims. Regarding "equivalents" an equivalent arrangement of the claimed apparatus is to have the lock channel 2 be affixed to the dock and the latching assembly 1 affixed to the watercraft. However, this would seem to be an undesirable burden on the watercraft owner as the latching assembly 2 would be more costly to build than the lock channel and furthermore there are many more ships than docking devices. The term "ferry boat" as used herein is intended to be a conventional ferry boat that is usually continuously driven against the dock to maintain it against the dock while loading and unloading passengers and cargo, and thus wasting fuel and increasing pollution.

I claim:

1. A docking mechanism for securely holding a watercraft directly and firmly against a stationary dock comprising:

(a) a dock mounted latching assembly having guide means for guiding a vertical lock channel mounted upon said watercraft toward and against a central portion of the latching assembly;

(b) a pair of movable cylinders mounted upon the central portion of the latching assembly;

(c) a drive piston and a piston actuator for moving the drive piston against the movable cylinders and causing the drive piston to contact the movable cylinders and position the drive cylinders firmly against the lock channel, thereby to firmly maintain the watercraft directly against the dock.

2. The docking mechanism of claim 1 wherein the vertical lock channel has portions thereof co-acting with surface portions of the drive piston for receiving and latching the cylinders against the lock channel.

3. The locking mechanism of claim 2 wherein the vertical lock channel includes a beam having surfaces forming a pair of crotches for receiving said pair of cylinders in a locking position.

4. The docking mechanism of claim 3 wherein said vertical lock channel is configured to enable relative vertical motion of said watercraft with respect to said dock.

5. The docking mechanism of claim 3 wherein the pivotable cylinders are configured having a variety of surface grooves, pits, cavities or detents that act to alleviate debris buildup and allow for easier washout and increased durability.

6. The docking mechanism of claim 2 wherein the drive piston has first surface portions configured to move the pivotable cylinders away from each other and toward a locked position and has second surface portions configured to wedge the cylinders against portions of said lock channel.

7. The docking mechanism of claim 6 wherein said vertical lock channel is configured to enable relative vertical motion of said watercraft with respect to said dock.

8. The docking mechanism of claim 6 wherein the pivotable cylinders are configured having a variety of surface grooves, pits, cavities or detents that act to alleviate debris buildup and allow for easier washout and increased durability.

9. The docking mechanism of claim 2 wherein said vertical lock channel is configured to enable relative vertical motion of said watercraft with respect to said dock.

10. The docking mechanism of claim 2 wherein the pivotable cylinders are configured having a variety of surface grooves, pits, cavities or detents that act to alleviate debris buildup and allow for easier washout and increased durability.

11. The docking mechanism of claim 1 wherein said vertical lock channel is configured to enable relative vertical motion of said watercraft with respect to said dock.

12. The docking mechanism of claim 1 wherein the set of movable cylinders are attached to pivotable links that rotate and bear against the vertical lock channel in a locking position.

13. A docking mechanism for securely holding a watercraft directly and firmly against a stationary dock comprising:

(a) a dock mounted latching assembly having guide means for guiding a vertical lock channel mounted upon said watercraft toward and against a central portion of the latching assembly;

(b) a pair of movable locking members mounted upon the dock mounted latching assembly;

(c) actuation means for moving the locking members against the vertical lock channel for firmly maintaining the watercraft directly against the dock; and (d) wherein the pair of movable locking members are pivotable links that rotate and bear against the vertical lock channel in a locking position.

14. The locking mechanism of claim 13 wherein the vertical lock channel includes a pair of vertically oriented rods.

15. The docking mechanism of claim 13 wherein the pair of movable locking members are a pair of cylinders mounted upon movable links.

16. The locking mechanism of claim 15 wherein the vertical lock channel includes a beam having surfaces forming a pair of crotches for receiving said pair of cylinders in a locking position.

17. The docking mechanism of claim 15 wherein said watercraft is a ferry boat.

18. The docking mechanism of claim 13 wherein said watercraft is a ferry boat.

19. A docking mechanism for securely holding a watercraft directly and firmly against a stationary dock comprising:

(a) a dock mounted latching assembly having guide means for guiding a vertical lock channel mounted upon said watercraft toward a central portion of the latching assembly;

(b) a pair of rotatable links positioned upon the central portion of the latching assembly;

(c) a chive piston and a piston actuator for moving the drive piston against the movable links and positioning them firmly against wall portions of the lock channel, thereby to firmly maintain the watercraft directly against the dock.

20. The docking mechanism of claim 19 wherein the vertical lock channel has a pair of elongated vertically oriented rods that are contacted by the rotatable links and that press them against the rods.

21. The docking mechanism of claim 20 wherein said vertical lock channel is configured to enable relative vertical motion of said watercraft with respect to said dock.

22. The docking mechanism of claim 19 wherein said vertical lock channel is configured to enable relative vertical motion of said watercraft with respect to said dock.

* * * * *